United States Patent [19]

Knipp et al.

[11] Patent Number: 4,710,158

[45] Date of Patent: Dec. 1, 1987

[54] METHOD AND APPARATUS FOR PRODUCING DECKLED EDGE PAPER

[75] Inventors: Randall S. Knipp, Kansas City; Lewis Loyd, Independence, both of Mo.

[73] Assignee: Hallmark Cards, Incorporated, Kansas City, Mo.

[21] Appl. No.: 42,515

[22] Filed: Apr. 24, 1987

Related U.S. Application Data

[63] Continuation of Ser. No. 832,530, Feb. 24, 1986, abandoned.

[51] Int. Cl.[4] ..... B26F 3/02

[52] U.S. Cl. ..... 493/328; 225/2; 225/3; 225/96; 225/98; 225/99; 493/369; 493/467

[58] Field of Search ..... 225/2, 3, 96, 94, 93, 225/98, 99; 162/286; 493/328, 369, 340, 467

[56] References Cited

U.S. PATENT DOCUMENTS

| | | | |
|---|---|---|---|
| 2,198,460 | 4/1940 | Rickard | 493/328 |
| 2,512,414 | 6/1950 | Booth | 225/96 X |
| 2,913,160 | 11/1959 | Fleming | 225/99 |
| 3,198,092 | 8/1965 | Koran | 493/328 |
| 3,854,249 | 12/1974 | Fletcher | 51/75 |
| 3,928,124 | 12/1975 | Hansen | 162/274 |
| 4,430,549 | 2/1984 | Macken | 219/121 LG |
| 4,601,692 | 7/1986 | Rausing et al. | 225/96 X |

FOREIGN PATENT DOCUMENTS

| | | | |
|---|---|---|---|
| 47-38479 | 9/1972 | Japan | 225/94 |

*Primary Examiner*—Frank T. Yost

*Attorney, Agent, or Firm*—Neuman, Williams, Anderson & Olson

[57] ABSTRACT

Process and apparatus for producing a deckle edge on paper which involves applying a stream of liquid to a paper to form a wetted line thereon and applying a shearing force sufficient to cause the paper to separate into two parts along the wetted line thereby producing a deckle edge on the paper.

18 Claims, 3 Drawing Figures

METHOD AND APPARATUS FOR PRODUCING DECKLED EDGE PAPER

This application is a continuation of application Ser. No. 832,530, filed Feb. 24, 1986, now abandoned.

BACKGROUND OF THE INVENTION

This invention relates to producing a deckle edge on paper. Paper having an irregular edge, i.e., a deckle edge is used extensively for stationery and greeting cards, which products are generally perceived as being more elegant and more costly than similar stationery or greeting cards having straight edges. Special efforts must be taken to produce a deckle edge on normal paper stock. For example, U.S. Pat. No. 4,430,549 relates to producing deckle edge paper using laser technology. Laser beam apparatus is quite sophisticated and expensive and laser beam technology requires considerable knowledge and skill in its application.

Other methods for producing deckle edge paper include grinding and sanding techniques. These methods result in the removal and loss of paper stock and create dust and safety problems.

OBJECTS OF THE INVENTION

Accordingly, it is an object of this invention to provide improved processes and apparatus for producing a deckle edge on paper.

Another object of the invention is to provide simplified processes for producing deckle-edged paper which do not involve use of expensive and highly sophisticated apparatus.

A still further object of the invention is to provide economical processes for producing deckle-edged paper which do not involve significant loss of paper stock and which do not pose serious dust and safety problems at the production site.

SUMMARY OF THE INVENTION

The invention involves a novel process for producing a deckle edge on paper which comprises applying a stream of liquid to a stock of paper to form a wetted line on said paper stock pattern along a predetermined path. Then a shearing force is exterted on the wetted paper sufficient to cause the paper stock to separate into two parts along the wetted line thereby producing a deckle edge on said paper.

Apparatus for use in accordance with the invention comprises means such as a conveyor for moving a stock of paper through a deckle edge production line. Hold down means are provided to firmly hold the paper stock on the conveyor in proper alignment and in substantially flat condition. Liquid supply means, including a liquid discharge outlet, provide for application of a stream of liquid to the paper stock as it is moved through the production line to form a wetted line therein in a predetermined path. Subsequent to the application of the liquid, the wetted paper is subjected to a shearing force perpendicular to the wetted line so as to split or tear the paper substantially therealong. The means for applying the shearing force in one embodiment comprises one or more splitter bars, the top surface of which is raised above the plane of the conveyor so as to exert a pulling apart action on the paper. Optionally, the apparatus includes edge finishing means which can take the form of a rigid bar under which the deckle edge passes whereby moisture is squeezed therefrom and the paper fibers pressed and set in flat condition. The finishing means can also take the form of a pair of cooperating rotating brushes with the deckle edge of the paper being passed into the nip thereof and subjected to a brushing action to remove moisture and set the paper fibers.

DESCRIPTION OF PREFERRED EMBODIMENTS

The following description of preferred embodiments of the present invention taken in conjunction with the drawings will further evidence the advantages of the invention.

Figure 1:
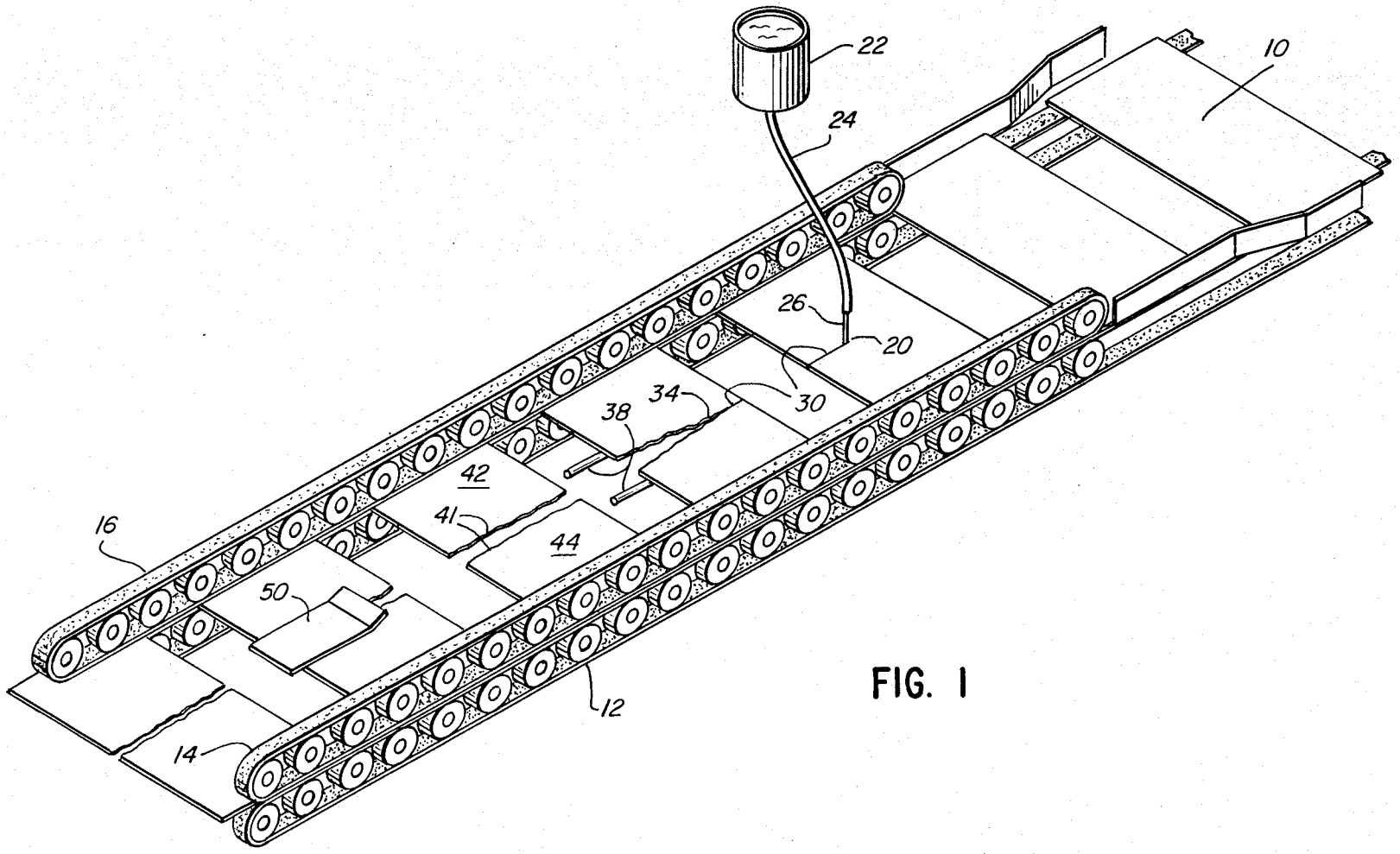
FIG. 1 is a schematic view of apparatus for producing a deckle edge on paper in accordance with the invention.

Referring to FIG. 1, a sheet of paper 10 is conveyed along a deckle edge production line by roller conveyor belt 12. Two longitudinally extending hold down roller belts 14 and 16 are positioned above and along the side edges of the roller conveyor belt 12. These belts 14 and 16 are spaced from the conveyor belt 12 an appropriate distance to exert a nipping or clamping pressure on the edges of the paper stock to hold the paper in proper alignment and in a substantially flat and relatively taut condition. As the paper stock moves forwardly in register on the conveyor belt 12, a stream 20 of liquid is directed onto the paper along a predetermined path. The liquid stream is delivered from supply container 22 through delivery line 24 and nozzle or needle 26, which is sized to deliver a relatively fine stream of liquid onto the paper to create a wetted line 30 thereon. The width of the wetted line 30 can be varied by regulating the size of nozzle 26 or by regulating the pressure of the liquid stream. Generally speaking, the wetted line 30 will range from about 1/16 to ⅜ inch in width. Also, the degree of penetration of the liquid into the paper stock can be controlled to large extent by controlling the amount of liquid applied and the time interval before shearing the paper. With a greater degree of penetraton of the liquid into the paper stock, the deckle edge is more jagged and coarse. Accordingly, the production line speed is regulated so as to achieve a desired degree of liquid penetration into the paper. If necessary or desired, a stream of liquid can also be applied from beneath the paper stock to insure that the wetted line 30 sufficiently penetrates the paper stock to render it susceptible to shearing. Water is a very suitable liquid for applying to the paper stock, although other liquids can be used, such as, for example, alcohols and the like. Moreover, additives such as Photoflow from Kodak Chemical Company, which enhance penetration of the liquid into the paper stock, can be incorporated into the liquid as well as dyes, mold resistant additives, etc.

Figure 2:
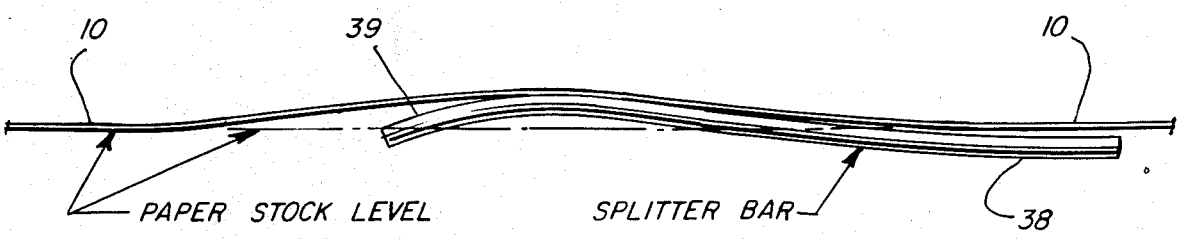
FIG. 2 is a schematic side view illustrating one form of means for applying a shearing force to the paper stock for producing a deckle edge in accordance with the invention.

After application of the liquid to form the wetted line 30, the paper is then subjected to a splitting operation at 34. The splitting operation at 34 involves exerting a shearing force on the paper generally perpendicular to the wetted line 30 so as to cause the paper to split into two parts in a direction generally parallel and along the wetted line. As illustrated in FIG. 1, the splitting operation can be conveniently accomplished by causing the wetted paper stock to pass over a pair of spaced splitter bars designated generally by the numeral 38 positioned on both sides of the wetted line 30. A single splitter bar positioned off-center of the wetted line 30, that is, positioned to either side of the mid-point of the wetted line 30 can also be employed. Generally, the splitter bar or splitter bars are positioned ⅜ to 2 inches away from the mid-point of the wetted line 30. One suitable form of splitter bar 38 is shown in FIG. 2 and comprises a relatively narrow bar having an inclined upper surface 39 which projects upwardly above the normal plane in which the wetted paper is travelling on the conveyor. As the paper passes over the upwardly projecting top surface 39 (FIG. 2) of the splitter bar, a shearing force or tearing apart action is exerted thereon along the wetted line. The shearing force is a result of the paper being stretched in transverse direction as it passes over the raised splitter bar while the sides of the paper are retained and held against the conveyor belt 12 by the hold down belts 14 and 16. The top surface 39 of the splitter bar projects a sufficient distance above the normal plane in which the paper is travelling as to exert transverse shearing force on the paper causing it to split or tear apart along the wetted line. Shearing or tearing apart of the paper stock along the wetted line produces two separate paper strips 42 and 44, both of which have a deckle edge 41 thereon. The splitting at 34 can also be accomplished by providing a pair of oppositely disposed gripping elements which grip the sides of the wetted paper sheet and mechanically pull apart the wetted paper. Similarlly, the conveyor 12 and the hold down conveyor belts 14 and 16 can be arranged so as to flare outwardly in transverse direction downstream of the point of application of the liquid.

Figure 3:
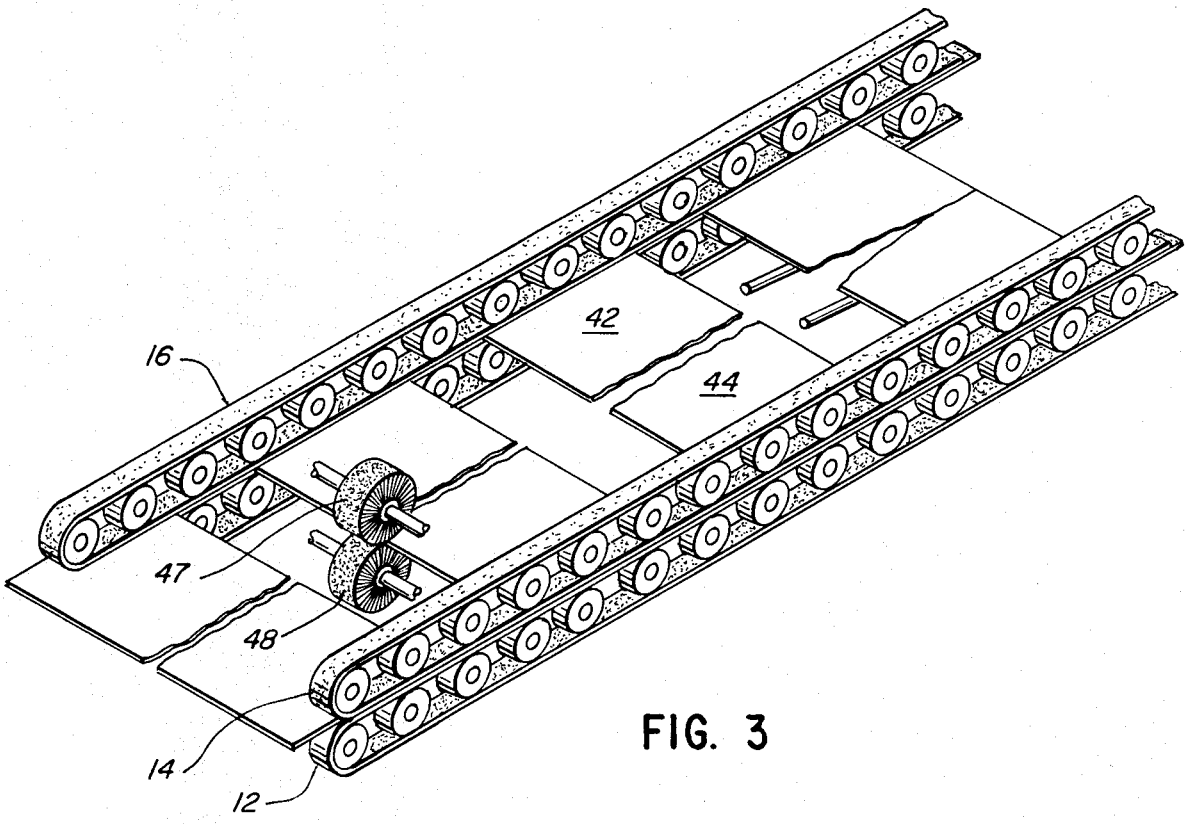
FIG. 3 is a view similar to FIG. 1 in part showing the arrangement of one form of finishing means in accordance with the invention.

After the splitting operation at 34, it is usually preferable, but not necessary, that the two deckle edged paper strips 42 and 44 be subjected to a finishing operation. The finishing operation can be accomplished by passing the deckle edge papers underneath a wiping pad 50 which serves to force moisture from the paper and to press and set the paper fibers in a deckle pattern. The wiping pad can take the form of a rigid bar, preferably having a layer of a soft material such as moleskin or lambs wool on its bottom surface, which exerts a squeezing action on the deckle edged papers. The finishing operation can be accomplished also, if desired, by passing the deckle edged papers 42 and 44 through the nip of two vertically spaced rotating brushes 47 and 48 (FIG. 3) to align and set the paper fibers forming the deckle edge. The deckle edge paper strips 42 and 44 can then be stored in sheet form or roll form or can be cut out to produce deckle edge papers of desired size.

According to the foregoing preferred embodiment of the invention, a deckle edge is formed on two pieces or strips of paper stock simultaneously. This is accomplished by forming the wetted line along which the shearing force is exerted in substantially the center of the paper stock to form the two deckle edge paper strips 42 and 44 of substantially equal width. The width of the deckle edged paper can be vaired by proper positioning of the wetted line and splitter bar. Thus, the wetted line 30 can be formed near a side edge of the paper stock and the splitter bar positioned accordingly to form two strips of deckle edged paper of unequal width on a small scrap strip.

In a typical operation, 65 pound Strathmore paper sheets approximately 8½ inches in length are processed on a deckle edge production line as illustrated in the drawings. The sheets of paper are processed at a rate of 6500 sheets per hour with a space of approximately ½ inch between each sheet. Water is applied to the paper sheets through a 1/16 ID nozzle under a pressure of 2–5 psi to form a wetted line. Shearing force is applied by passing the wetted paper sheets over two splitter bars positioned approximately 1 inch on both sides of the wetted line on the paper. The paper sheets resulting from the processing have a deckle edge thereon.

Those modifications and equivalents which fall within the spirit of the invenion are to be considered a part thereof.

What is claimed is:

1. A process for producing a deckle edge on greeting card or stationery paper which comprises:

(a) depositing a web of paper stock adapted for greeting card or stationery use into conveyor means, (b) maintaining the said web of paper stock on the conveyor means in a taut and substantially flat condition, (c) applying a stream of liquid to said paper stock to form a wetted line of desired width thereon along a predetermined path, (d) transporting said wetted paper stock to a splitting operation, (e) exerting a shearing force on the wetted paper stock sufficient to cause the paper stock to split into two parts in a direction along the wetted line thereby producing a deckle edge on both separated parts of the paper, and (f) removing moisture from the separated parts of the paper stock to set the paper fibers.

2. A process according to claim 1 wherein water is the liquid applied to the paper stock.

3. A process according to claim 1 wherein water containing a penetration-improving additive is the liquid applied to the paper stock.

4. A process according to claim 1 wherein a stream of liquid is applied to the top and bottom of said paper stock to form said wetted line.

5. A process according to claim 1 wherein in step (e) the wetted paper stock is passed over a splitter element protruding above the surface plane of the conveyor which causes the paper stock to split into two parts in a direction along the wetted line thereby producing a deckle edge on both separated parts of the paper.

6. A process according to claim 1 wherein moisture is removed by evaporation.

7. A process according to claim 1 wherein moisture is removed by exerting pressure on the wetted paper stock.

8. A process according to claim 1 wherein moisture is removed by brushing the wetted paper stock.

9. A process according to claim 1 wherein in step (d) the rate of transporting is controlled to achieve a desired degree of liquid penetration.

10. Apparatus for forming a deckle edge on greeting card or stationery paper comprising:

means for conveying paper stock adapted for greetng card or stationary use on which a deckle edge is to be produced, means for retaining said paper stock on said conveying means in a taut and substantially flat condition, means for delivering a stream of liquid onto said paper stock to form a wetted line of desired width along a predetermined path, and means for applying a shearing force to said wetted paper sufficient to cause said paper stock to split into two parts in a direction along the wetted line thereby producing a deckle edge on both separated parts of the paper.

11. Apparatus in accordance with claim 10 which includes means for controlling the rate of transporting the wetted paper stock to the means for applying a shearing force.

12. Apparatus in accordance with claim 10 wherein the means for delivering a stream of liquid comprises a liquid supply line and nozzle means.

13. Apparatus in accordance with claim 10 wherein the means for delivering a stream of liquid involves means above and below said paper stock.

14. Apparatus in accordance wth claim 10 wherein the means for applying a shearing force to said wetted paper comprises a splitter element protruding above the surface plane of the conveyor means which causes the paper stock to split into two parts in a direction along the wetted line thereby producing a deckle edge on both separated parts of the paper.

15. Apparatus in accordance with claim 10 wherein the means for applying a shearing force to said wetted paper comprises oppositely disposed gripping elements which pull apart the paper stock causing it to split into two parts in a direction along the wetted line thereby producing a deckle edge on both separated parts of the paper.

16. Apparatus in accordance with claim 10 which also includes means for removing moisture from the separated parts of the paper.

17. Apparatus in accordance with claim 16 wherein the means for removing moisture from the separated parts of the paper comprises pressing means.

18. Apparatus in accordance with claim 16 wherein the means for removing moisture from the separated parts of the paper comprises brusing means.

* * * * *